US009266646B2

(12) United States Patent
Oakes

(10) Patent No.: US 9,266,646 B2
(45) Date of Patent: Feb. 23, 2016

(54) CUTLERY UTENSIL DISPENSING PACKAGE

(71) Applicant: Dixie Consumer Products LLC, Atlanta, GA (US)

(72) Inventor: Shawn A. Oakes, Ripon, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 0 days.

(21) Appl. No.: 13/954,180

(22) Filed: Jul. 30, 2013

(65) Prior Publication Data

US 2014/0069930 A1 Mar. 13, 2014

Related U.S. Application Data

(60) Provisional application No. 61/697,819, filed on Sep. 7, 2012.

(51) Int. Cl.

| | |
|---|---|
| ***B65D 25/42*** | (2006.01) |
| ***B65D 1/24*** | (2006.01) |
| ***B65D 1/26*** | (2006.01) |
| ***B65D 83/02*** | (2006.01) |
| ***B65D 47/04*** | (2006.01) |

(52) U.S. Cl.

CPC *B65D 25/42* (2013.01); *B65D 1/24* (2013.01); *B65D 1/26* (2013.01); *B65D 47/046* (2013.01); *B65D 83/02* (2013.01)

(58) Field of Classification Search

CPC ..... B65D 25/42; B65D 1/24; B65D 47/046; B65D 83/02; B65D 83/08; B65D 1/26; B65D 25/38; A47F 1/08; A47F 1/04; A47F 1/00

USPC ..... 206/467, 766, 738; 220/254.1, 254.3, 220/525; 221/305, 194; 229/122.1, 121, 229/211, 122

See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Laing et al. |
| 925,485 | A | 6/1909 | Lafler |
| 999,387 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
European Search Report for 060009258.2, mailed Jul. 24, 2006, five mages, Munich, Germany.

(Continued)

*Primary Examiner* — Steven A. Reynolds
(74) *Attorney, Agent, or Firm* — William W. Leston

(57) ABSTRACT

The present application provides a dispensing package for a number of articles therein. The dispensing package may include a tub and a reclosable lid enclosing the tub. The reclosable lid may include a dispensing aperture, one or more mating slots, and a spout flap forming a reclosable spout.

27 Claims, 6 Drawing Sheets

(56) References Cited

U.S. PATENT DOCUMENTS 1,259,927 A 3/1918 Swift
1,261,835 A 4/1918 Martin
1,353,109 A 9/1920 Carr
1,355,583 A 10/1920 Zeidler et al.
1,482,071 A 1/1924 Duff et al.
1,497,585 A 6/1924 Poole
1,504,098 A 8/1924 Cathey
1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A 7/1928 Nolan
1,767,634 A 6/1930 Weiss
1,821,377 A 9/1931 Cusick
1,886,378 A 11/1932 George
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,340,561 A 2/1944 Renfro
2,401,534 A 6/1946 Welch
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,881,247 A 4/1959 Levine et al.
2,889,076 A 6/1959 Van Schie
2,907,512 A * 10/1959 Leone ..... 229/122.1
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,021,919 A 2/1962 Peters
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 Good
3,371,821 A 3/1968 Abood et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Albert
3,499,538 A 3/1970 Sherard
3,558,006 A 1/1971 Redmond et al.
3,587,922 A 6/1971 Oriti
3,593,908 A * 7/1971 Desmond et al. ..... 229/122
3,654,396 A 4/1972 Biezeveld
3,680,736 A 8/1972 Wiessmann
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,861,563 A 1/1975 Lisbin
3,862,702 A 1/1975 Johnson
3,897,886 A 8/1975 Franklin
3,932,978 A 1/1976 Kinney
3,944,128 A * 3/1976 Hogan ..... 229/221
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,382,514 A * 5/1983 Williams ..... 229/221
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson
4,614,004 A 9/1986 Oshida
4,624,616 A 11/1986 Freese et al.
4,638,921 A 1/1987 Sigl et al.
4,662,536 A 5/1987 Powers
4,666,037 A * 5/1987 Weissman ..... 206/63.5

(56) References Cited

U.S. PATENT DOCUMENTS 4,666,060 A 5/1987 Bouldin
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,793,539 A 12/1988 Haenni et al.
4,835,864 A 6/1989 Tang
4,863,033 A 9/1989 Buj
4,884,718 A * 12/1989 Leahy ..... 220/835
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,953,781 A 9/1990 Bryan
4,961,684 A 10/1990 Provan et al.
4,963,072 A 10/1990 Miley et al.
RE33,447 E * 11/1990 Rosman ..... 220/4.21
4,973,037 A 11/1990 Holbrook
4,986,442 A 1/1991 Hinterreiter
4,989,730 A * 2/1991 Lemoine ..... 206/362
4,995,154 A 2/1991 Bamber
5,012,927 A * 5/1991 Borst ..... 206/470
D318,600 S 7/1991 Lillelund et al.
5,054,640 A * 10/1991 Tucker ..... 220/716
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,156,266 A * 10/1992 Sykora ..... 206/216
5,161,268 A 11/1992 Harrow
5,176,494 A 1/1993 Nigrelli et al.
5,191,997 A 3/1993 Squitieri
5,199,756 A 4/1993 Bartlett et al.
5,211,267 A 5/1993 Clark
D336,047 S 6/1993 Kim
5,249,705 A 10/1993 Gates
5,263,596 A 11/1993 Williams
D342,648 S 12/1993 Cautereels et al.
5,269,397 A 12/1993 Kawamoto et al.
5,288,361 A 2/1994 Konno
5,305,875 A * 4/1994 Meyer ..... 206/45.25
5,325,992 A 7/1994 Schmid et al.
5,327,650 A 7/1994 Rojas
D351,085 S 10/1994 Schmidt
5,353,935 A * 10/1994 Yeager et al. ..... 206/470
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A * 12/1996 Bennett ..... 206/362
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A 5/1999 De Schutter
5,921,408 A 7/1999 Groenwold et al.
5,933,918 A 8/1999 Wallays
5,950,842 A 9/1999 Bauer
5,961,021 A 10/1999 Koike et al.
D420,887 S 2/2000 Chen
6,023,908 A 2/2000 Vetsch
6,023,913 A 2/2000 Gray et al.
D422,431 S 4/2000 Goins
6,047,830 A 4/2000 Chang
6,062,424 A * 5/2000 Simile-Gravina et al. .... 221/305
6,073,795 A * 6/2000 Longstreth ..... 220/574
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 6/2001 Lovejoy
6,289,889 B1 9/2001 Bell et al.
6,298,960 B1 10/2001 Derr
6,336,568 B1 1/2002 Tucker et al.
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,951,266 B2 10/2005 Tournier
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 * 4/2007 Bone ..... 229/242
7,210,279 B1 5/2007 Ahmed et al.
7,237,700 B2 7/2007 Bulovic
7,249,793 B1 7/2007 Jabr et al.
7,258,233 B2 * 8/2007 Lee ..... 206/470
7,322,172 B2 1/2008 Hoffman et al.
D564,819 S 3/2008 Fosburg et al.
7,412,808 B2 8/2008 Lavi
7,434,692 B2 * 10/2008 Ginsberg et al. ..... 206/535
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
D631,337 S * 1/2011 Prevost ..... D9/421
8,070,013 B2 12/2011 Reinsel et al.
8,083,058 B2 * 12/2011 Marcinkowski et al. ..... 206/352
8,083,097 B2 12/2011 Kaufman et al.
8,152,004 B2 4/2012 Smith et al.
8,210,364 B2 7/2012 Smith et al.
8,272,533 B1 9/2012 D'Amelia et al.
8,296,957 B2 10/2012 Muehlemann
8,297,473 B2 10/2012 Smith
8,302,269 B2 11/2012 Pitman
8,360,273 B2 1/2013 Reinsel et al.
8,444,006 B2 5/2013 Dixon

(56) References Cited

U.S. PATENT DOCUMENTS

| | | | | |
|---|---|---|---|---|
| 8,480,954 | B2 | 7/2013 | Talmer et al. | |
| 8,776,379 | B2 | 7/2014 | Walters et al. | |
| 8,789,704 | B2 | 7/2014 | Nowak | |
| 8,839,522 | B2 | 9/2014 | Walters et al. | |
| 8,844,798 | B2 | 9/2014 | Linkel | |
| 9,169,039 | B2 | 10/2015 | Freeman | |
| 2001/0007308 | A1* | 7/2001 | Glassman | 206/469 |
| 2001/0025856 | A1 | 10/2001 | Lefevre Du Grosriez et al. | |
| 2002/0112445 | A1 | 8/2002 | Scaduto | |
| 2003/0015824 | A1 | 1/2003 | Forbes et al. | |
| 2003/0098344 | A1* | 5/2003 | Blake | 229/122.1 |
| 2003/0146061 | A1 | 8/2003 | Tournier | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2004/0237311 | A1 | 12/2004 | Brown et al. | |
| 2005/0035136 | A1 | 2/2005 | Dathe et al. | |
| 2005/0082307 | A1 | 4/2005 | Tucker | |
| 2005/0116482 | A1 | 6/2005 | Harris et al. | |
| 2005/0155186 | A1 | 7/2005 | McGuyer et al. | |
| 2005/0155229 | A1 | 7/2005 | Lee | |
| 2005/0211722 | A1 | 9/2005 | Runnels | |
| 2005/0252057 | A1 | 11/2005 | Lavi | |
| 2006/0000190 | A1 | 1/2006 | Behnke et al. | |
| 2006/0042986 | A1* | 3/2006 | Simkowski | 206/470 |
| 2006/0053638 | A1 | 3/2006 | Sumner-Trivisani et al. | |
| 2006/0218795 | A1 | 10/2006 | Santa Cruz et al. | |
| 2006/0249531 | A1 | 11/2006 | Litchfield et al. | |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2007/0214650 | A1 | 9/2007 | Tomazini | |
| 2007/0250391 | A1 | 10/2007 | Prade et al. | |
| 2008/0118609 | A1* | 5/2008 | Harlfinger | 426/106 |
| 2008/0121650 | A1 | 5/2008 | Smith | |
| 2008/0128445 | A1 | 6/2008 | Huang et al. | |
| 2009/0194557 | A1 | 8/2009 | Van Deursen | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2011/0296693 | A1 | 12/2011 | Oakes | |
| 2012/0036724 | A1 | 2/2012 | Walters | |
| 2012/0047744 | A1 | 3/2012 | Walters | |
| 2012/0080444 | A1 | 4/2012 | Smith et al. | |
| 2012/0110746 | A1 | 5/2012 | Serrano et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 | 2/2013 | Oakes | |
| 2013/0126548 | A1 | 5/2013 | Pourian et al. | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0117036 | A1 | 5/2014 | Smith et al. | |
| 2014/0299656 | A1 | 10/2014 | Wintermute | |
| 2015/0028045 | A1 | 1/2015 | Oakes et al. | |
| 2015/0028046 | A1 | 1/2015 | Oakes et al. | |
| 2015/0041363 | A1 | 2/2015 | Freeman et al. | |
| 2015/0041484 | A1 | 2/2015 | Oakes | |
| 2015/0048108 | A1 | 2/2015 | Borke | |

FOREIGN PATENT DOCUMENTS

| | | | |
|---|---|---|---|
| CN | 101066183 | A | 11/2007 |
| CN | 101495015 | A | 7/2009 |
| DE | 7033238 | U | 11/1970 |
| DE | 7127677 | | 11/1971 |
| DE | 3151268 | A1 | 7/1983 |
| DE | 4139938 | A1 | 6/1993 |
| DE | 202005013647 | U1 | 7/2006 |
| EP | 0257109 | A1 | 8/1986 |
| EP | 0286538 | A1 | 10/1988 |
| EP | 0856272 | A3 | 1/1999 |
| EP | 1022107 | A1 | 7/2000 |
| EP | 1217923 | B1 | 9/2003 |
| EP | 1358827 | A2 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | JH06121727 | A | 5/1994 |
| JP | 08011934 | A | 1/1996 |
| JP | 08-047440 | | 2/1996 |
| JP | 3042582 | U | 10/1997 |
| JP | 2001354214 | A | 12/2001 |
| JP | 2004261336 | A | 9/2004 |
| JP | 2007319493 | A | 12/2007 |
| KR | 20-1991-0008085 | | 10/1991 |
| KR | 10-2009-0071515 | A | 7/2009 |
| KR | 100954569 | B1 | 4/2010 |
| TW | M287639 | U | 2/2006 |
| TW | M293720 | U | 7/2006 |
| WO | 2004028309 | A1 | 4/2004 |
| WO | 2007049982 | A1 | 5/2007 |
| WO | 2009137367 | A2 | 11/2009 |

OTHER PUBLICATIONS

International Search Report and Written Opinion for PCT/US2009/059915, Mailed Feb. 3, 2010, 13 pages, European Patent Office, Munich, Germany.

International Search Report and Written Opinion for PCT/US2011/044931, mailed Feb. 28, 2012.

International Search Report and Written Opinion for PCT/US2011/044934, mailed Mar. 6, 2012.

International Search Report and Written Opinion for PCT/US2011/058329.

International Search Report and Written Opinion for PCT/US2011/058767, dated Feb. 29, 2012.

International Search Report and Written Opinion for PCT/US2011/064057, dated Feb. 29, 2012.

PCT International Search Report and Written Opinion PCT/US2007/083752, Mar. 11, 2008, 10 pages.

PCT International Search Report and Written Opinion PCT/US2007/083922 mailed Nov. 17, 2008, 10 pages.

Supplementary European Search Report for EP 11 79 3088 dated Sep. 25, 2013.

European Search Report for EP 08 014 387.8, mailed Nov. 11, 2008, four pages, European Patent Office, Munich, Germany.

European Patent Search Report EP 08 01 4387.8 dated Nov. 11, 2008, four pages, Germany.

International Search Report and Written Opinion for PCT/US2007/083922 mailed Nov. 17, 2008, 10 pages.

International Searching Authority, "International Search Report and Written Opinion for PCT/US2014/047463", mailed Nov. 26, 2014, 22 pages, Korean Intellectual Property Office, South Korea.

International Searching Authority, "International Search Report and Written Opinion for PCT/US2014/050166", mailed Nov. 20, 2014, 11 pages, Korean Intellectual Property Office, South Korea.

International Searching Authority, "International Search Report and Written Opinion for PCT/US2014/050169", mailed Jan. 9, 2015, 11 pages, Korean Intellectual Property Office, South Korea.

International Searching Authority, "International Search Report and Written Opinion for PCT/US2014/051632", mailed Dec. 3, 2014, 9 pages, Korean Intellectual Property Office, South Korea.

International Searching Authority, "International Search Report and Written Opinion for PCT/US2014/051639", mailed Dec. 9, 2014, 9 pages, Korean Intellectual Property Office, South Korea.

International Search Report and Written Opinion for PCT/US2010/000051, mailed Aug. 16, 2010, 6 pages.

* cited by examiner

CUTLERY UTENSIL DISPENSING PACKAGE

TECHNICAL FIELD

The present application and the resultant patent relate generally to a cutlery utensil dispensing package and more particularly relate to a cutlery utensil dispensing package with a reclosable spout for ease of use, ease of transport, and ease of storage.

BACKGROUND OF THE INVENTION

Eating facilities and other locations often provide disposable cutlery utensils such as a knife, a fork, a spoon, a spork, and the like in dispensing bins for retrieval by a customer. Although such arrangements provide for easy and economical dispensing of the cutlery utensils as compared to sets of utensils being separately wrapped in plastic sleeves, the dispensing bins generally must be manually restocked with the cutlery utensils. Specifically, the cutlery utensils may be packaged and shipped to the facility in one package and then manually transferred to the dispensing bins as needed. Moreover, the dispensing bins may or may not be easy to relocate or suitable for outdoor events or other types of temporary uses requiring the transport of the cutlery utensils.

There is thus a desire for an improved cutlery utensil dispensing package. Such an improved cutlery utensil dispensing package may be suitable for shipping and transporting the cutlery utensils therein while also providing for easy dispensing of the cutlery utensils therefrom. Moreover, such a package may be easily openable and reclosable.

SUMMARY OF THE INVENTION

The present application and the resultant patent thus may provide a dispensing package for a number of articles positioned therein. The dispensing package may include a tub and a reclosable lid enclosing the tub. The reclosable lid may include a dispensing aperture, one or more mating slots, and a spout flap forming a reclosable spout thereon.

The present application and the resultant patent further may provide a method of dispensing articles from a package. The method may include the steps of receiving the package with the articles therein, opening a lid or a spout of the lid on one end of the package, removing one or more articles from the package, reclosing the lid or the spout, and storing the package for future use.

The present application and the resultant patent further may provide a dispensing package for a number of cutlery utensils therein. The dispensing package may include a tub with one or more feet on one or more ends thereof and a lid enclosing the tub. The lid may include a dispensing aperture, one or more mating slots, and a spout flap forming a spout so as to provide access to the cutlery utensils through the dispensing aperture.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
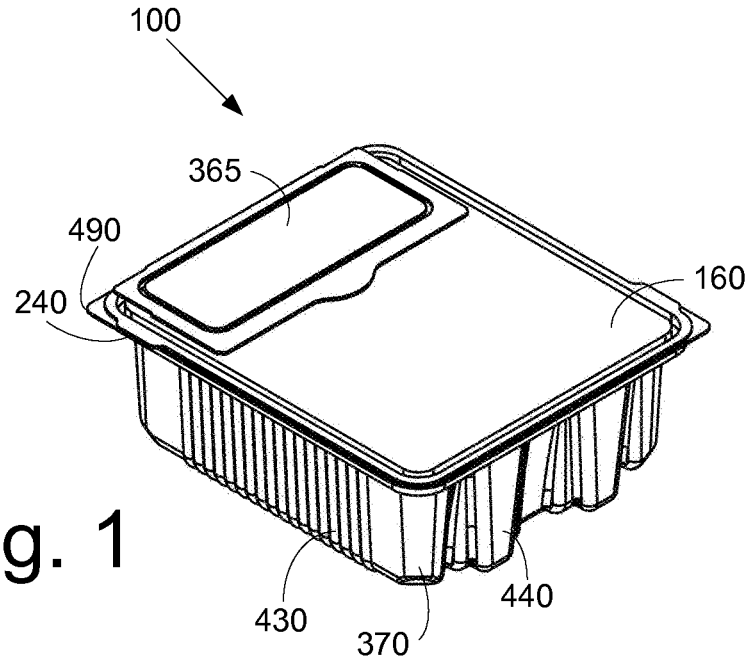
FIG. 1 is perspective view of a cutlery utensil dispensing package as may be described herein.

Referring now to the drawings, in which like numerals refer to like elements throughout the several views, FIG. 1 shows an example of a cutlery utensil dispensing package 100 as may be described herein. In describing the cutlery utensil dispensing package 100, the terms "bottom," "top," "side," "end," "first," "second," and the like are used for purposes of relative orientation only and not as an absolute position. For example, most of the surfaces of the cutlery utensil dispensing package 100 may be used as the bottom or the top as oriented by the user. The cutlery dispensing package 100 may have any suitable size, shape, or configuration. Any number of cutlery utensil dispensing packages 100 may be used together.

The cutlery utensil dispensing package 100 may be made out of any suitably formable thermoplastic material. Examples of suitable materials may include polyethylene terephthalate, polystyrene, polypropylene, polyvinyl chloride, polyethylene, and the like. Other materials such as metals, wood, composites, and the like also may be used herein. The material may be substantially clear or the material may have any type of coloring. Depending upon the nature of the material, the cutlery utensil dispensing package 100 may be manufactured via thermoforming, vacuum forming, and the like. Other types of manufacturing techniques such as an injection molding process also may be used. The cutlery utensil dispensing package 100 may have graphics or other types of identification and/or marketing indicia thereon.

Figure 2:
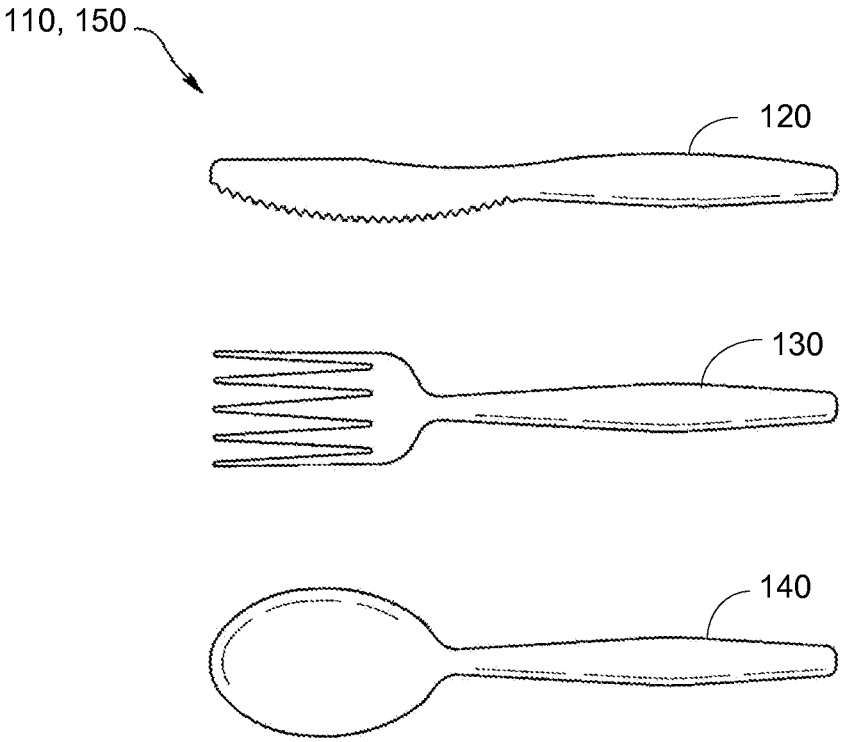
FIG. 2 is a top plan view of several examples of cutlery utensils that may be used with the cutlery utensil dispensing package of FIG. 1.
Figure 3:
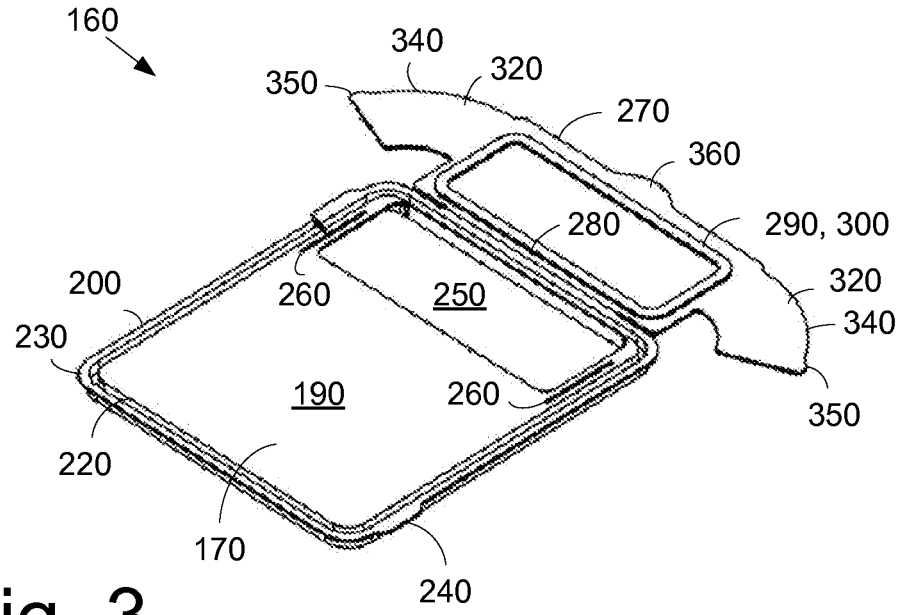
FIG. 3 is a perspective view of a lid for use with the cutlery utensil dispensing package of FIG. 1.
Figure 4:
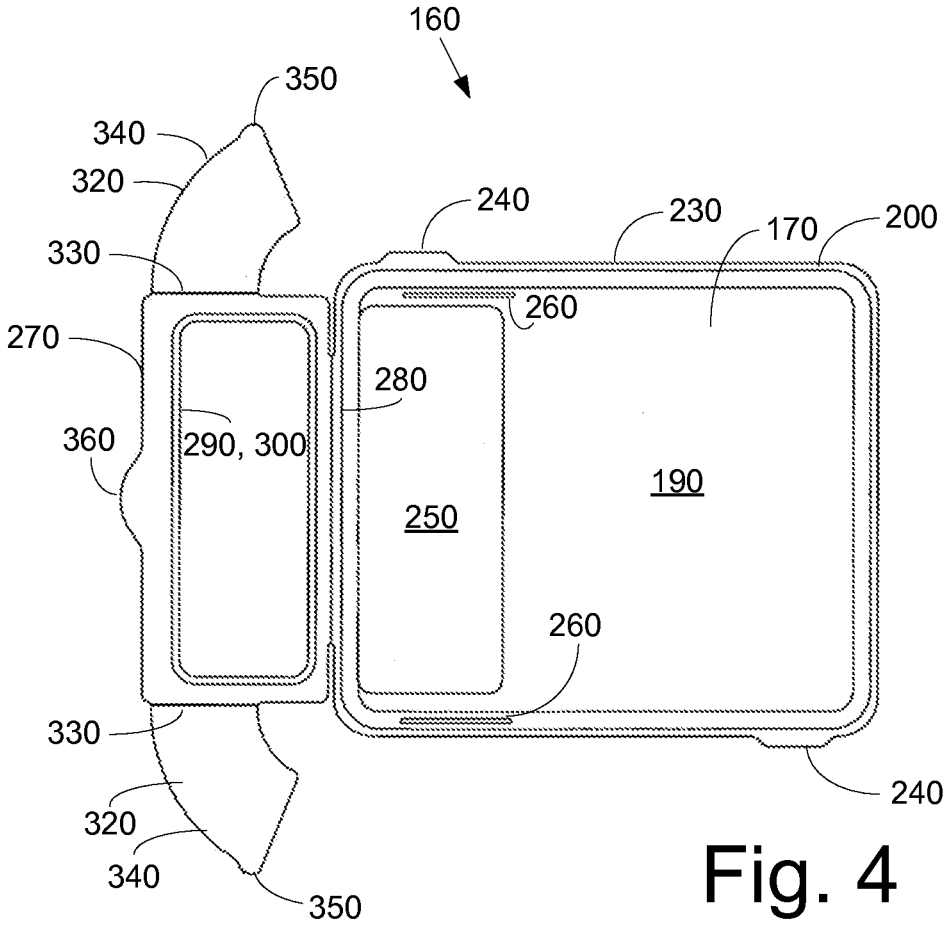
FIG. 4 is a bottom plan view of the lid of FIG. 3.
Figure 5:
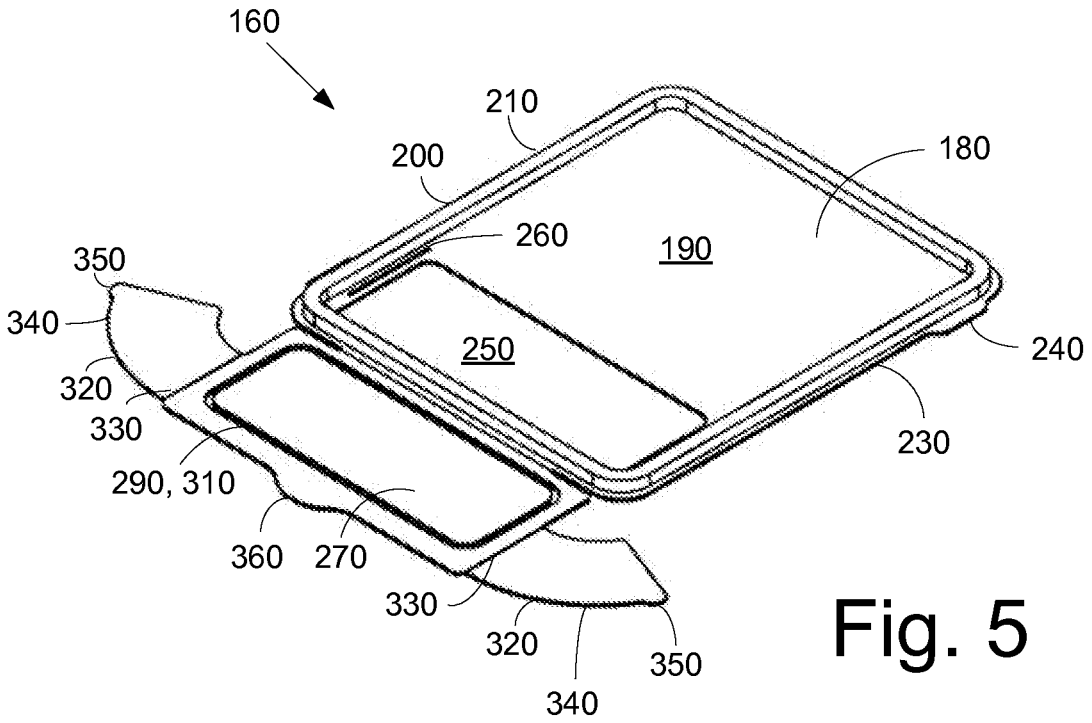
FIG. 5 is a top plan view of the lid of FIG. 3.
Figure 6:
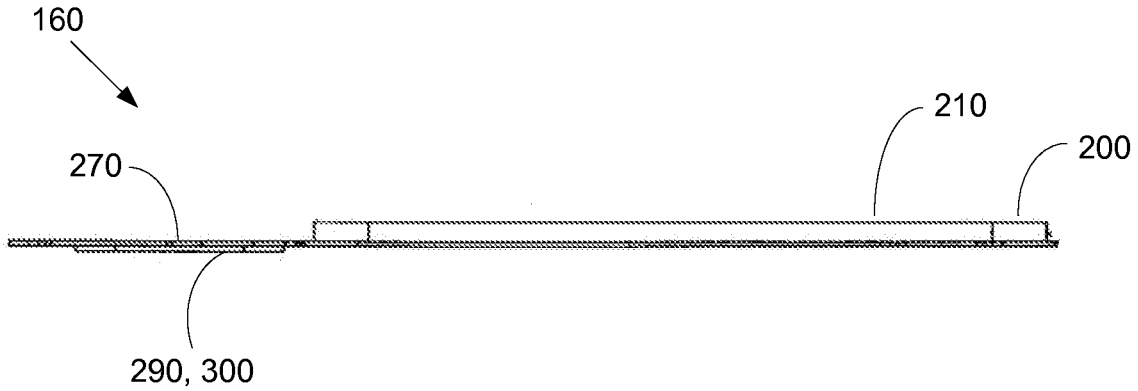
FIG. 6 is a side plan view of the lid of FIG. 3.
Figure 7:
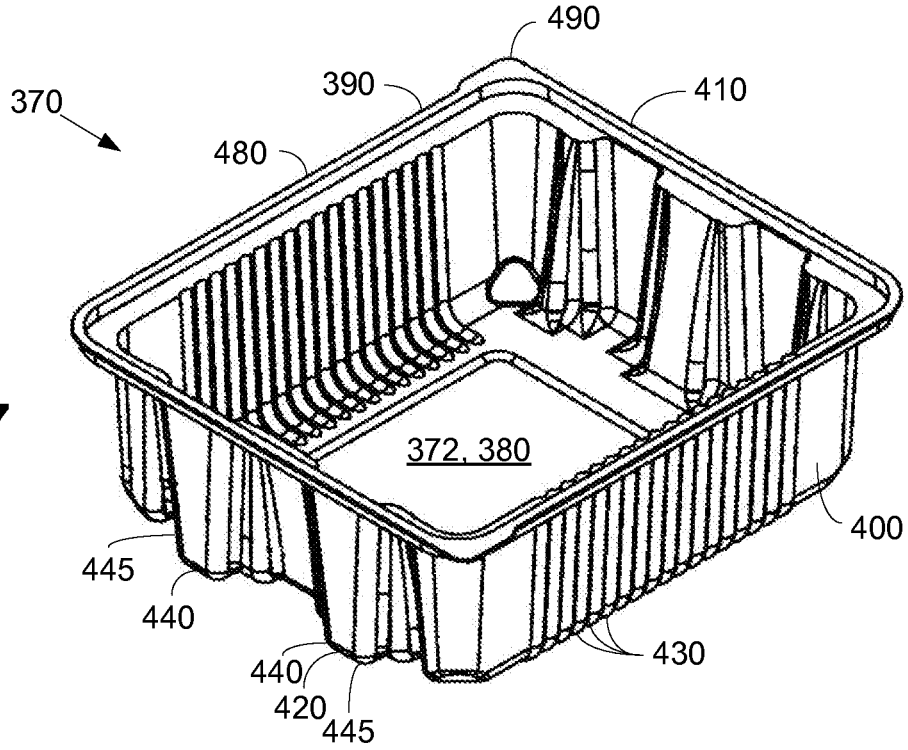
FIG. 7 is a perspective view of a tub for use with the cutlery utensil dispensing package of FIG. 1.
Figure 8:
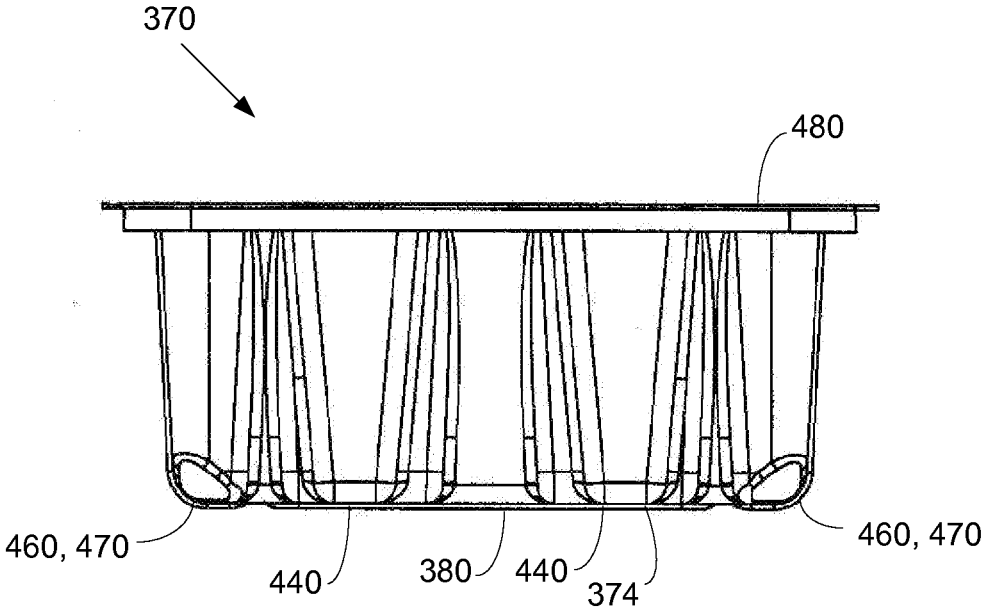
FIG. 8 is an end plan view of the tub of FIG. 7.
Figure 9:
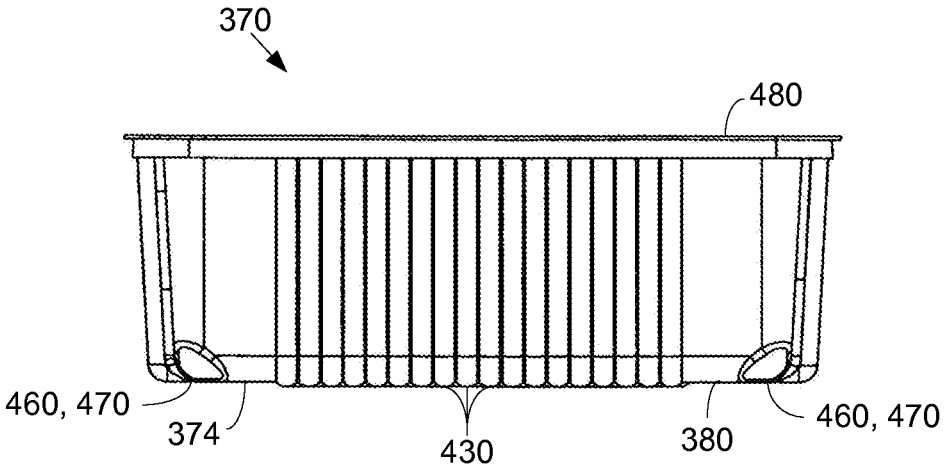
FIG. 9 is a side plan view of the tub of FIG. 7.
Figure 10:
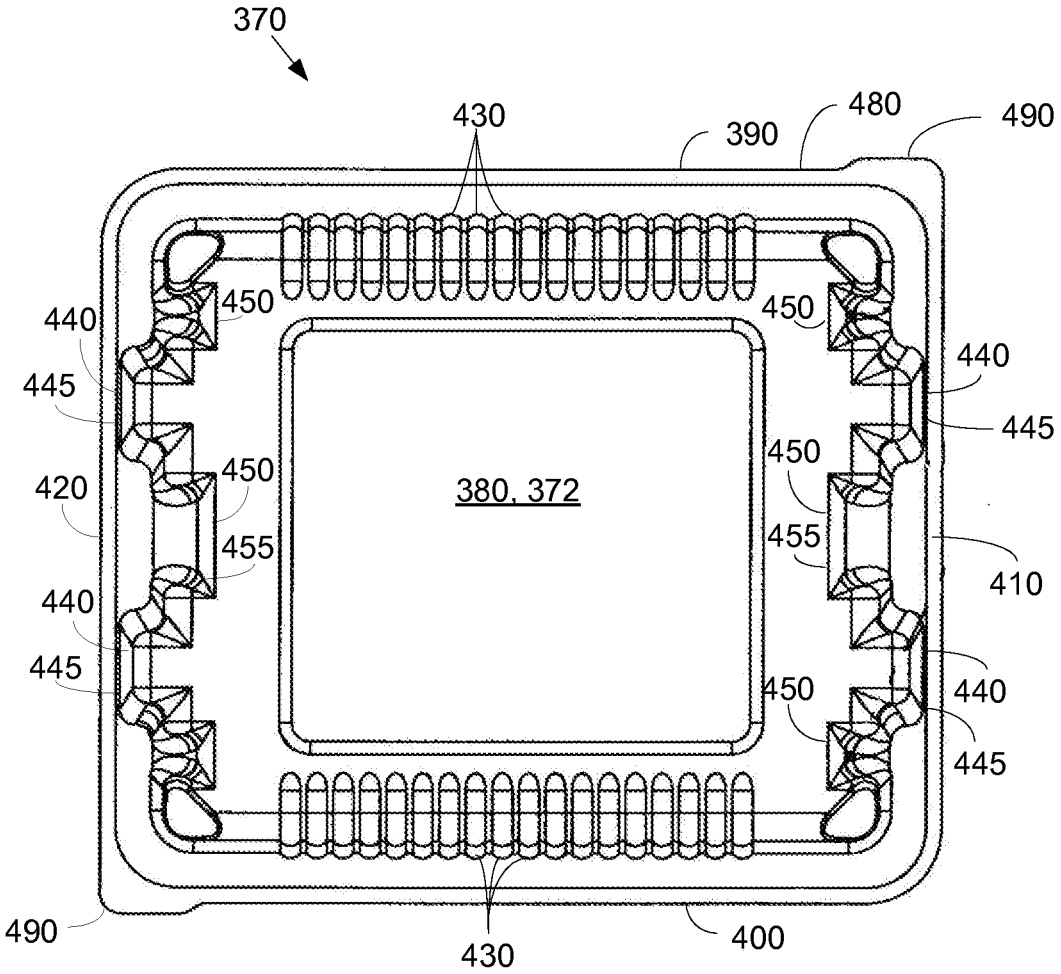
FIG. 10 is a top plan view of the tub of FIG. 7.

The cutlery utensil dispensing package 100 may be used with a number of cutlery utensils 110. Any number of the cutlery utensils 110 may be used herein in any size, shape, or configuration. As is shown in FIG. 2, examples of the cutlery utensils 110 may include a knife 120, a fork 130, and a spoon 140. Other types of cutlery utensils 110, such as a spork and the like, also may be used herein. The cutlery utensils 110 may be disposable and/or recyclable. The cutlery utensils 110 may be made out of a thermoplastic material suitable for the purposes disclosed herein. Other materials such as metals, wood, composites, and the like also may be used herein. Although the cutlery utensil dispensing package 100 will be described in terms of the cutlery utensils 110, the cutlery utensil dispensing package 100 also may be suitable for almost any type of a substantially disposable product 150. Examples include, but are not limited to, condiment packages, drinking straws, paper products, and the like. Moreover, the cutlery utensil dispensing package 100 also may be used with almost any type of substantially disposable products 150 outside of the food service industry. The scope of the cutlery utensil dispensing package 100 described herein is not limited by the nature of the articles that may be used.

FIGS. 3-6 show a lid 160 that may be used with the cutlery utensil dispensing package 100. Generally described, the lid 160 may include a first side 170 and a second side 180. The lid 160 may include a center panel 190. The center panel 190 may be surrounded by a peripheral lip 200. The peripheral lip 200 may be formed by an undercut 210 extending from the second side 180 and forming a recess 220 in the first side 170. The peripheral lip 200 may be continuous or intermittently shaped. The peripheral lip 200 may have any suitable size, shape, or configuration. The peripheral lip 200 may be surrounded by an outer flange 230. The outer flange 230 may have any suitable size, shape, or configuration. A number of opening tabs 240 may extend from the flange 230. The opening tabs 240 may have any suitable size, shape, or configuration.

The center panel 190 of the lid 160 may have a dispensing aperture 250 formed therein. The dispensing aperture 250 may have any suitable size, shape, or configuration. The dispensing aperture 250 may extend from the first side 170 to the second side 180 of the lid 160. The positioning of the dispensing aperture 250 along the center panel 190 may vary. The dispensing aperture 250 may be sized and configured to allow access to the cutlery utensils 110 or other objects therein while reducing unnecessary environmental exposure and possible contamination issues. The center panel 190 also may include a number of mating slots 260 formed therein. The mating slots 260 may be positioned on either side of the dispensing aperture 250 and adjacent to the peripheral lip 200. The mating slots 260 may have any suitable size, shape, or configuration.

The lid 160 also may include a spout flap 270. The spout flap 270 may have any suitable size, shape, or configuration. The spout flap 270 may be connected to the center panel 190 via a spout hinge 280. The spout hinge 280 may be coined, scored, or otherwise indented so as to allow for folding. The spout flap 270 may include a spout lip 290 formed therein. The spout lip 290 may include a spout undercut 300 extending into the second side 180 and forming a spout recess 310 on the first side 170. The spout lip 290 may be continuous or intermittent. The spout lip 290 may be sized and shaped such that the spout lip 290 accommodates the size and shape of the dispensing aperture 250 and may be removably positioned therein.

The spout lip 290 also may include a pair of guide flaps 320. The guide flaps 320 may be attached to the spout flap 270 via a pair of flap hinges 330. The flap hinges 330 may be coined, scored, or otherwise indented so as to allow for folding. The guide flaps 320 may have a substantially curved shape 340. The guide flaps 320 may be sized and shaped so as to accommodate the mating slots 260 on the center panel 190. The guide flaps 320 may have a protrusion 350 or any suitable retention feature at a far end thereof. The spout flap 270 also may have an opening tab 360 on one end thereof. Other suitable sizes, shapes, and configurations may be used herein. As will be described in more detail below, the spout flap 270 cooperates with the dispensing aperture 250 to form a dispensing spout 365 on the lid 160.

FIGS. 7-10 show an example of a tub 370 that may be used with the cutlery utensil dispensing package 100. The tub 370 is any type of structure that may retain the cutlery utensils 110 therein and may be enclosed by the lid 160. The tub 370 may include an inside surface 372 and an outside surface 374. The tub 370 may include a bottom floor 380, a first sidewall 390, an opposed second sidewall 400, a first end wall 410, and an opposed second end wall 420. Although the end walls 410, 420 are shown as being of lesser length than the sidewalls 390, 400, the end walls 410, 420 may be of equal or greater length. The tub 370, the floor 380, the sidewalls 390, 400, and the end walls 400, 410 may have any suitable sizes, shapes, or configurations.

The sidewalls 390, 400 may include a number of ribs 430 formed therein. The ribs 430 may have any suitable size, shape, or configuration. Any suitable number of the ribs 430 may be used herein. The ribs 430 may provide structural strength and may provide for a grip surface and the like. The end walls 410, 420 may have a number of feet 440 extending on the outside surface 374 thereof. The feet 440 may have a substantially flat configuration 445. Likewise, the end walls 410, 420 may have a number of ramps 450 extending into the inside surface 372. The ramps 450 may have a substantially angled configuration 455. The ramps 450 may be interspersed between the feet 440. Although two feet 440 and three ramps 450 are shown, any suitable number of the feet 440 and the ramps 450 may be used. The feet 440 may have the flat configuration 445 so as to allow the tub 370 and the overall cutlery utensil dispensing package 100 to stand on either end wall 410, 420. The ramps 450 may have the angle configuration 455 so as to feed the cutlery utensils 120 towards the dispensing aperture 250. The feet 440 and the ramps 450 may have any suitable sizes, shapes, or configurations.

The tub 370 also may have a number of corners 460 positioned at the intersections between the sidewalls 390, 400 and the end walls 410, 420. The corners 460 may have a substantially angled configuration 470. The angled configuration 470 may add overall strength to the tub 370. The corners 460 may have any suitable size, shape, or configuration.

The sidewalls 390, 400 and the end walls 410, 420 of the tub 370 may be surrounded by a raised lip 480. The raised lip 480 may be sized and shaped so as to accommodate the undercut 210 of the peripheral lip 200 of the lid 160. The raised lip 480 may be continuous or intermittent. One or more opening tabs 490 may project from the raised lip 480. The opening tabs 490 may have any suitable size or shape. Other components and other configurations also may be used herein.

In use, the guide flaps 320 may fold about the flap hinges 330. The guide flaps 320 may be positioned within the mating slots 260 such that the spout flap 270 may pivot about the flap hinge 280 so as to enclose the dispensing aperture 250 and form the spout 365. Specifically, the undercut 300 of the spout lip 290 may be positioned within the dispensing aperture 350. The guide flaps 320 may remain positioned at about ninety degrees with respect to the spout flap 270 or the guide flaps 320 may be folded inward along the spout flap 270 at any suitable angle.

The tub 370 may be filled with the cutlery utensils 110 or other types of substantially disposable products 150. The tub 370 then may be enclosed by the lid 160 with the undercut 210 of the peripheral lip 200 of the lid 160 accommodating the raised lip 480 of the tub 370. The cutlery utensils dispensing package 110 may be shrink wrapped or otherwise packaged and shipped to the consumer. The consumer then may remove the lid 160 from the tub 370 via the opening tabs 360, 490 and access the cutlery utensils 110 therein. The consumer may reapply the lid 160 at any time.

Figure 11:
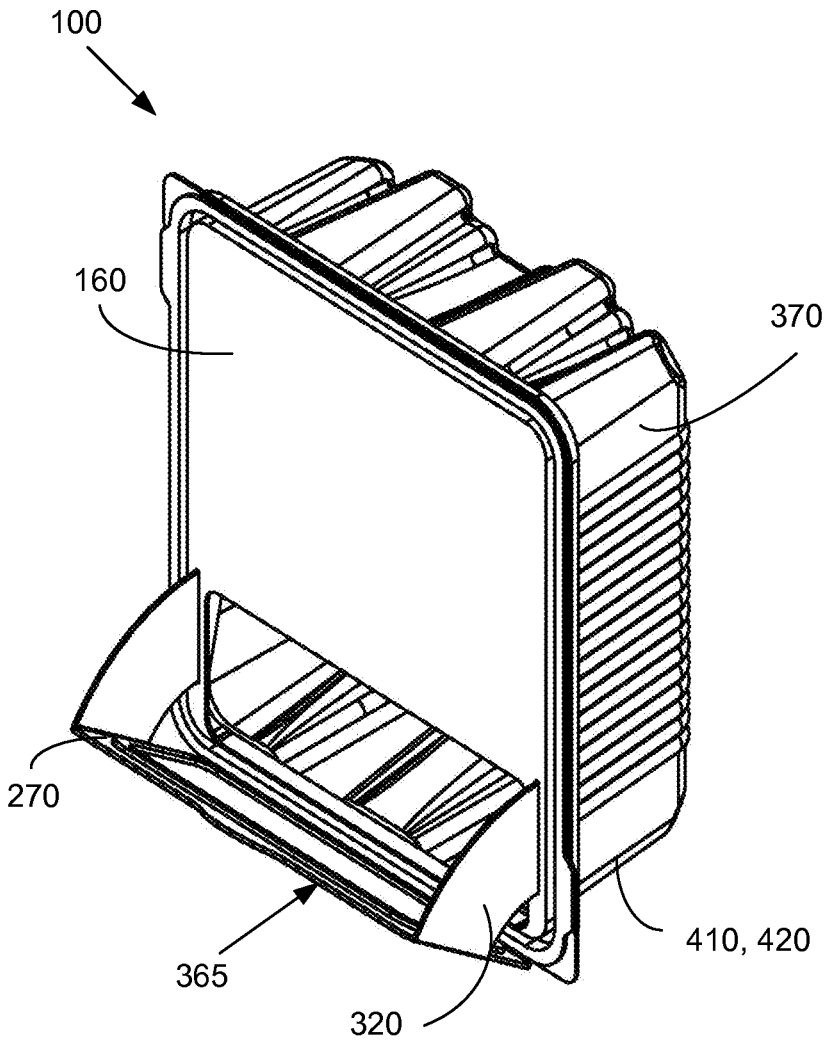
FIG. 11 is a perspective view of the cutlery utensil dispensing package of FIG. 1 with an open spout.

Alternatively, the consumer may open the spout 365 by pulling on the opening tab 360 of the spout flap 270. The spout flap 270 may pivot outwardly and downwardly so as to open the dispensing aperture 250. Specifically, the spout flap 270 may pivot along the length of the curved shaped 340 of the guide flaps 320. The rotation of the spout flap 270 may be halted by the protrusions 350 coming into contact with the lid 360. The cutlery utensil dispensing package 100 may be positioned on one end 410, 420 as is shown in FIG. 11. The consumer may then remove the cutlery utensils 110 therein. The spout 365 may be reclosed at any time. The cutlery utensil dispensing package 100 may be stored for future use. The spout flap 270 also may be removed from the lid 160 if desired.

The spout 365 may be opened and closed as often as desired. Likewise, the lid 160 may be removed from and reapplied to the tub 370 as often as desired. The cutlery dispensing package 100 thus may be easy to transport, use, and store. The cutlery utensil dispensing package 100 may be used in restaurants, in break rooms, at home, at the office, at school, on-the-go, picnics, or almost anywhere. The cutlery utensil dispensing package 100 allows for the transport, the use, and the storage of cutlery utensils 110 and other types of dispensing products 150 in a single easy to use container. Cutlery utensil dispensing packages 100 with different types of cutlery utensils 110 therein may be positioned adjacent to each other or otherwise used together. Alternatively, the cutlery utensil dispensing package 100 may have a number of compartments accessible by a lid 160 with multiple spouts 365.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A dispensing package for a number of articles therein, the dispensing package comprising:
- a tub defining an interior space configured to contain the number of articles; and
- a reclosable lid enclosing the interior space, the reclosable lid comprising:
  - a panel comprising an exterior side, an interior side a dispensing aperture extending from the exterior side to the interior side, and a lip extending along a periphery of the panel and removably engaging the tub; and
  - a spout flap connected to the panel and movable from a closed position covering the dispensing aperture to an open position spaced apart from the dispensing aperture and forming a spout configured to allow access to the number of articles through the dispensing aperture.

2. The dispensing package of claim 1, wherein the dispensing package is formed of a thermoplastic material.

3. The dispensing package of claim 1, wherein the lip extends continuously along the entire periphery of the panel and surrounds the dispensing aperture.

4. The dispensing package of claim 1, wherein the lip comprises an undercut extending from the interior side and a recess formed in the exterior side.

5. The dispensing package of claim 3, wherein the panel further comprises an outer flange surrounding the lip, and one or more opening tabs extending from the outer flange.

6. The dispensing package of claim 1, wherein the reclosable lid further comprises a spout hinge connecting the spout flap to the panel.

7. The dispensing package of claim 1, wherein the panel further comprises one or more mating slots extending from the exterior side to the interior side, and wherein the reclosable lid further comprises one or more guide flaps connected to the spout flap and movably received within the one or more mating slots and the interior space.

8. The dispensing package of claim 7, wherein the one or more guide flaps comprise a protrusion configured to limit movement of the spout flap relative to the dispensing aperture.

9. The dispensing package of claim 1, wherein the spout flap comprises a spout lip removably received within the dispensing aperture.

10. The dispensing package of claim 1, wherein the tub comprises one or more end walls comprising one or more feet extending along an outer surface thereof.

11. The dispensing package of claim 10, wherein the one or more end walls further comprise one or more ramps extending along an inner surface thereof.

12. The dispensing package of claim 11, wherein the one or more feet comprise a flat configuration, and wherein the one or more ramps comprise an angled configuration.

13. The dispensing package of claim 1, wherein the tub comprises a pair of sidewalls each comprising a plurality of ribs.

14. The dispensing package of claim 1, wherein the tub comprises a pair of sidewalls, a pair of end walls, and a raised lip surrounding the sidewalls and the end walls, and wherein the lip of the panel removably engages the raised lip of the tub.

15. A method of dispensing a number of articles from a dispensing package, the method comprising:
- receiving the dispensing package comprising:
  - a tub defining an interior space containing the number of articles; and
  - a reclosable lid enclosing the interior space, the reclosable lid comprising:
    - a panel comprising an exterior side, an interior side, a dispensing aperture extending from the exterior side to the interior side, and a lip extending along a periphery of the panel and removably engaging the tub; and
    - a spout flap connected to the panel;
- moving the spout flap from a closed position covering the dispensing aperture to an open position spaced apart from the dispensing aperture and forming a spout;
- accessing one or more of the articles through the dispensing aperture; and
- removing the one or more articles from the dispensing package.

16. A dispensing package for a number of articles therein, the dispensing package comprising:
- a tub defining an interior space configured to contain the number of articles; and
- a reclosable lid enclosing the interior space, the reclosable lid comprising:
  - a panel comprising an exterior side, an interior side, a dispensing aperture extending from the exterior side to the interior side, a pair of mating slots extending from the exterior side to the interior side, and a lip extending along a periphery of the panel and removably engaging the tub;
  - a spout flap connected to the panel and movable from a closed position covering the dispensing aperture to an open position spaced apart from the dispensing aperture and forming a spout configured to allow access to the number of articles through the dispensing aperture; and
  - a pair of guide flaps each connected to the spout flap and movably received within one of the mating slots and the interior space.

17. The dispensing package of claim 16, wherein the dispensing package is formed of a thermoplastic material.

18. The dispensing package of claim 16, wherein the reclosable lid further comprises a spout hinge connecting the spout flap to the panel.

19. The dispensing package of claim 16, wherein the reclosable lid further comprises a pair of flap hinges each connecting one of the guide flaps to the spout flap.

20. The dispensing package of claim 16, wherein the spout flap comprises a spout lip removably received within the dispensing aperture.

21. The dispensing package of claim 16, wherein the lip extends continuously along the entire periphery of the panel and surrounds the dispensing aperture.

22. The dispensing package of claim 16, wherein the mating slots are separate from and spaced apart from the dispensing aperture.

23. The dispensing package of claim 1, wherein the dispensing aperture is spaced apart from the periphery of the panel.

24. The dispensing package of claim 1, wherein the spout flap is larger than the dispensing aperture.

25. The dispensing package of claim 1, wherein the spout flap is integrally formed with the panel.

26. The dispensing package of claim 1, wherein the lid is removably attached to the tub.

27. The dispensing package of claim 9, wherein the spout lip is spaced apart from a periphery of the spout flap.

* * * * *